United States Patent [19]

Müller et al.

[11] Patent Number: 4,679,413

[45] Date of Patent: Jul. 14, 1987

[54] FLAT-BED KNITTING MACHINE HAVING A SPOOL TABLE PROVIDED WITH MOVABLE YARN SPOOL HOLDERS

[75] Inventors: Adam Müller; Ernst Goller, both of Reutlingen, Fed. Rep. of Germany

[73] Assignee: H. Stoll GmbH & Co., Fed. Rep. of Germany

[21] Appl. No.: 890,266

[22] Filed: Jul. 29, 1986

[30] Foreign Application Priority Data

Aug. 9, 1985 [DE] Fed. Rep. of Germany ..... 3528693

[51] Int. Cl.[4] ..... D04B 3/06

[52] U.S. Cl. ..... 66/125 R; 242/131

[58] Field of Search ..... 66/64, 60, 125 R, 126 R; 242/131

[56] References Cited

U.S. PATENT DOCUMENTS 3,962,890 6/1976 Krause ..... 66/125 R 4,467,624 8/1984 Schimko ..... 66/126

*Primary Examiner*—Ronald Feldbaum

*Attorney, Agent, or Firm*—Jones, Tullar & Cooper

[57] ABSTRACT

A flat-bed knitting machine having a spool table disposed above the needle bed and carriage apparatus, in a rear area of the machine, is described. A multiplicity of yarn spool holders, which are movable into a front area above the needle bed and carriage apparatus, and a plurality of yarn supply devices are held on the spool table. To make the individual yarn spools of such a flat knitting machine more accessible, with less effort, even during machine operation, the yarn spool holders are divided into sets of a plurality of holders, and each set of holders is secured on a pull-out rail of a pull-out device. The pull-out rail is movable relative to a guide rail of the pull-out apparatus, and the guide rail is secured on the stationary spool table.

16 Claims, 4 Drawing Figures

FLAT-BED KNITTING MACHINE HAVING A SPOOL TABLE PROVIDED WITH MOVABLE YARN SPOOL HOLDERS

FIELD OF THE INVENTION

The present invention relates to a flat-bed knitting machine having a spool table disposed in a rear area of the machine above the needle bed and carriage apparatus. A multiplicity of yarn spool holders, which are movable in a front area above the needle bed and carriage apparatus, and a multiplicity of yarn supply devices are held on the spool table.

BACKGROUND OF THE INVENTION

In a flat-bed knitting machine of this type, known from German Pat. No. 32 43 315 C1, the entire spool table including the multiplicity of yarn spools and yarn supply devices, is movable from a rear position to a front position. Since the spool table, with all these elements, is very heavy, this is accomplished by driving a translating it via gear wheels and racks, which is relatively costly. Nevertheless, even though the spool table moves into a front position, it is still difficult to gain access to the yarn spools that are in a back row. Furthermore, in the known flat knitting machine the spool table is movable only out of a rear position, in which it protrudes substantially beyond the back of the flat knitting machine, to a front position in which the front edge of the spool table only to approximately above the middle of the needle bed apparatus. This again dictates that access to the individual yarn spools is still difficult, because it is still necessary to reach past half of the needle bed and carriage apparatus, which is a considerable distance.

OBJECT AND SUMMARY OF THE INVENTION

It is accordingly an object of the present invention to provide a flat-bed knitting machine of the above type in which the mechanism for moving the yarn spools in simplified and the individual yarn spools are more accessible, with less effort, even during operation of the machine.

In a flat-bed knitting machine of this type, this object is attained by providing sets of yarn spool holders disposed on pull-out bars, which are movable relative to guide rails that are secured to the spool table.

Because the yarn spool holders can be moved in sets, the invention advantageously enables easy access even to the yarn spools located in a back row. Furthermore, this also considerably simplifies the mechanism for moving each set of spools, because no special provisions for preventing tilting of the pull-out means or special driving or translating mechanisms are necessary; it is sufficient merely to move each set of yarn spool holders manually.

According to a preferred exemplary embodiment of the present invention, the pull-out bar can be pulled out past the area of the front needle bed; this means that at least the yarn spools located in one of the front rows are easily accessible without using tools, while all the other yarn spools in the back row are reachable without undue effort.

The spool table is advantageously provided with grooves extending in the longitudinal direction, in which the guide rails can be secured, extending at an angle thereto, preferably at an acute angle to the transverse direction of the spool table. The yarn spool holders of a set are disposed one after the other on the pull-out bar. On the other hand, since each set of yarn spool holders can be moved horizontally, yet along an oblique path extending from back to front, it is particularly simply attained that the yarn spools even in the back row or rows become easily visible and reachable without hindrance from the yarn spools of the front row or rows.

In another feature of the present invention, the pull-out bar is covered, over at least part of its length, by an elongated element having a groove-like profile, the width of which is greater than that of the element and the downwardly projecting side walls of which are supported indirectly on adequate transverse stability and guidance of the movable part of the pull-out apparatus that holds the yarn spools.

In a further feature of the invention, the side walls of the elongated element extending over the entire length of the pull-out bar are provided on their free edges with a cord element of plastic or rubber. Since the elongated element is thus supported on both its sides on the surface of the spool table via these cord elements, a pull-out brake is simply and advantageously attained as well, which retains the pull-out bar in any arbitrary pull-out position, and in particular in the fully retracted rear position of repose.

In order to be able in a simple manner to limit the retraction movement of the pull-out bar into its position of repose, the pull-out bar is provided on its front end with a cap that covers at least part of the guide rail. In this way, the cap that is provided for protection simultaneously serves as a limit stop.

The guide rail and pull-out bar are advantageously part of a roller pull-out apparatus, which can furthermore also be embodied as a telescoping pull-out means.

The spool table secured to the machine stand is preferably composed of a plurality of extruded aluminum profile elements, which are provided with a flat surface and with the securing grooves for the guide rails, and of which a front profile element is provided with at least one guide holder for a protective cover of the machine.

Further details and embodiments of the invention will become apparent from the ensuing detailed description of an exemplary embodiment, taken in conjunction with the drawings.

DESCRIPTION OF THE PREFERRED EMBODIMENT

Figure 1:
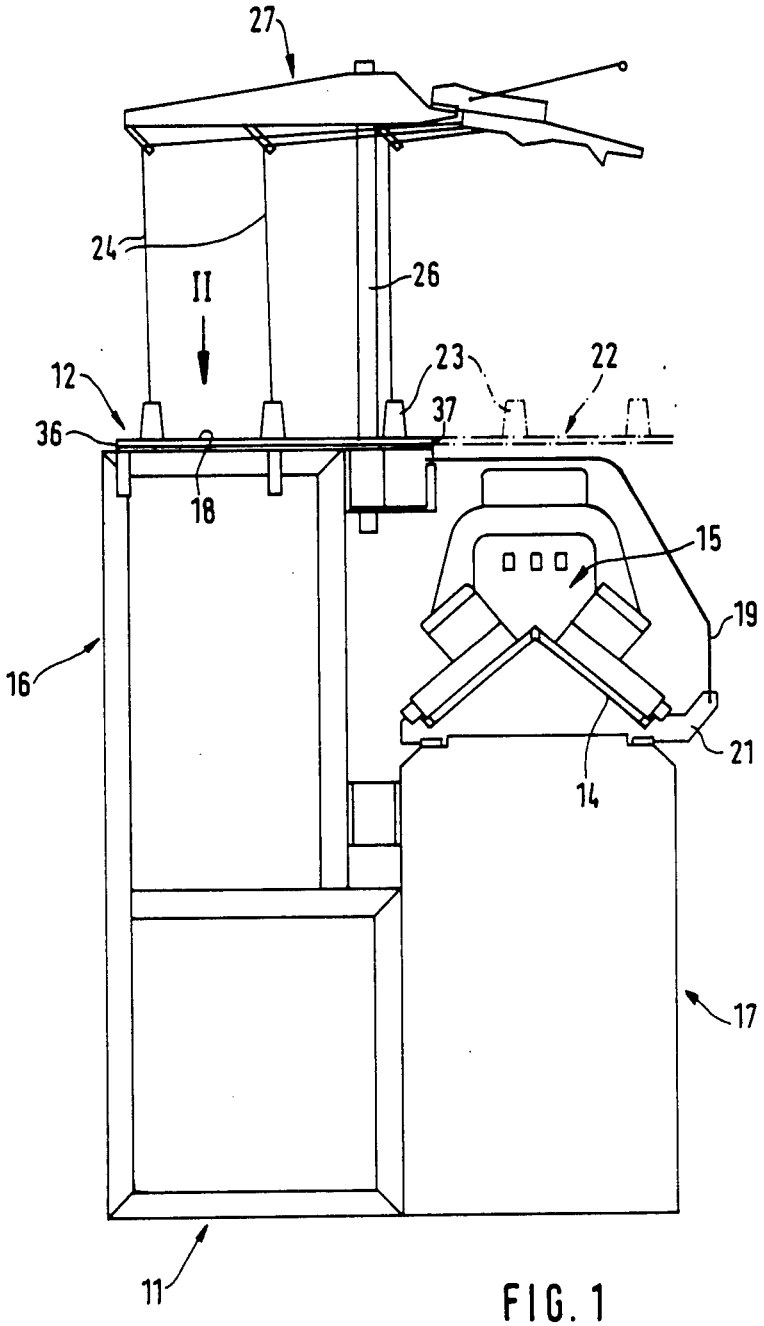
FIG. 1 is a schematic side view of a flat-bed knitting machine according to a preferred exemplary embodiment of the present invention.

The flat-bed knitting machine 11 in a preferred exemplary embodiment of the invention shown in the drawing is provided in accordance with the invention with a spool table 12, embodied such that the individual yarn spools 13 are movable in sets from a position located above and substantially behind the needle bed apparatus 14 and the carriage apparatus 15 to a front position, indicated by dot-dash lines in FIG. 1, in which the yarn spools 13 of both the front and back row or rows are accessible substantially without tools, so that they may be replaced or the like, during operation of the flat-bed knitting machine 11.

According to FIG. 1, the flat-bed knitting machine 11 has a rear machine frame 16, on which the drive mechanisms for the carriage apparatus 15 and for removing the goods and the like are secured, and on which the spool table 12 is secured or held stationary, as well as a front machine frame 17, which holds the needle bed apparatus 14 with the carriage apparatus 15. The relative heights are such that the surface 18 of the spool table 12 is disposed in a plane located above a protective cover 19 for the needle bed apparatus 14 and the cariage apparatus 15. The protective cover 19 is retained and guided in a ledge 21 held on the upper front long side of the front machine frame 17 and on a front area of the spool table 12 below its surface 18. Yarn supply devices 27 for supplying the yarns 24, in a manner not shown, from the yarn spools 13 to yarn guides and to the needles of the needle bed apparatus 14 are located on supports 26 on the spool table 12.

Figure 2:
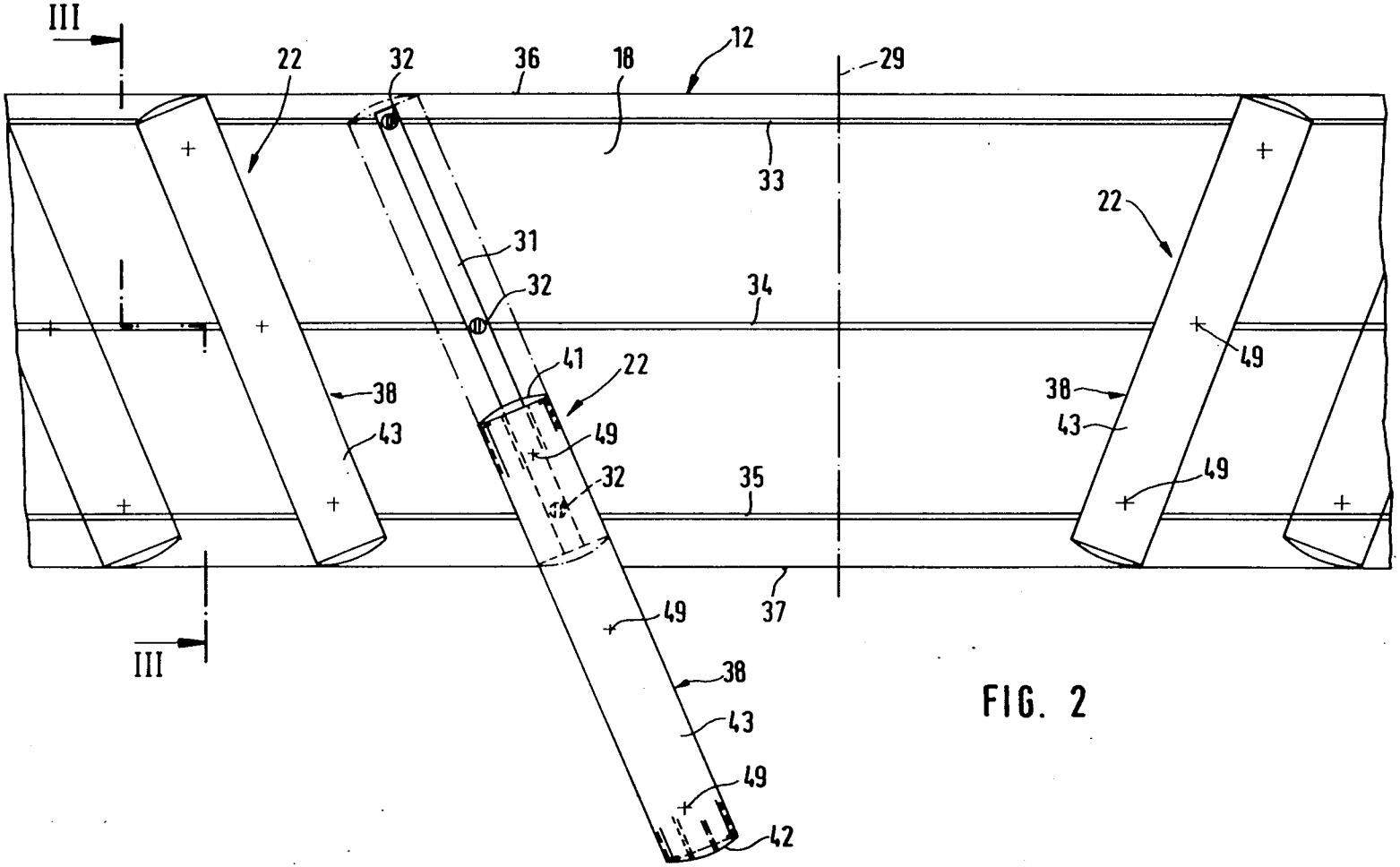
FIG. 2 is a fragmentary schematic plan view of the spool table of FIG. 1, seen in the direction of the arrow II, with the spool holders removed.

A plurality of pull-out apparatuses 22 are secured on the spool table 12, each of which has a set, three in number in this case, of yarn spool holders 23 for the yarn spools 13. According to FIGS. 2–4, the spool table 12 is provided on both sides of its transverse central plane 29 with a multiplicity, seven in number in this case, of pull-out apparatuses 22, which extend at an acute angle to the transverse central plane 29; the pull-out apparatuses 22 of both the left and right halves of the spool table 12 extend from back to front toward the transverse central plane 29. Each pullout apparatus 22, which is embodied in the form of a typical, perhaps telescoping, roller pull-out apparatus, has a stationary guide rail 31, secured for instance at three points by means of screws 32 in grooves 33, 34, 35 extending parallel to one another in the longitudinal direction. The guide rail 31 extends from the back edge 36 as far as the front edge 37 of the spool table 12. The approximately U-shaped guide rail 31 is covered by a likewise approximately U-shaped but oppositely inverted pull-out rail 38, in which roller bearings, preferably ball bearings 39, are retained between its side walls. The pull-out rail 38 is the same length as the guide rail 31 and has a protective cap 41, 42 on its two ends. While the rear protective cap 41 has an opening for the passage through it of the guide rail 31, the front protective cap 42 extends downward as far as the vicinity of the guide rail 31, so that it simultaneously serves as a stop to limit the insertion movement of the pull-out rail 38 into its position of repose, which is shown for the two leftmost and two rightmost pull-out apparatuses 22 shown in FIG. 2. In FIG. 2, however, the middle one of the five pull-out apparatuses 22 shown is shown in its maximally pulled out position. The pull-out rail 38 is covered by an elongated element 43 of groove-like cross section, the side walls 44 of which face the spool table 12. The groove-like element 43 is substantially wider than the pull-out rail 38, but is the same length. In the middle, and again pointing toward the spool table 12, the groove-like element 43 has two parallel extensions 46, which fit over the side walls of the pull-out rails 38 substantially without play. The free edges 47 of the side walls 44 of the groove-like element 43 have a recess for a cord element 48, which is made of a suitable plastic or rubber and secured in the recess. The groove-like element 43 is joined immovably to the pull-out rail 38 with the aid of screws 49. These screws 49 simultaneously serve each to connect one yarn spool holder 23 firmly to the groove-like element 43 (see FIG. 4 and the locations marked + in FIG. 2).

The yarn spool holders 23 are secured in sets, in this case three in number, spaced apart by a constant distance, to the pull-out apparatus 22 or to the groove-like element 43. At points at which the yarn spool holders 23 are provided, pull-out rail 38 and the groove-like element are also firmly joined to one another. The yarn spool holder 23 has an upright pin 52, into which the screw 49 is screwed, and a conical body 52 mounted on the pin 51 and held there by friction, with the yarn spool 13 mounted on this conical body 52 in the manner indicated by the dot-dash lines in FIG. 4; the quill 53 of the yarn spool 13 is seated on the groove-like element 43.

As illustrated by FIGS. 1 and 2 and as already noted, the pull-out rail 38, with a set of for instance three yarn spool holders 23 or yarn spools 13 mounted on them, is movable out of a rear position of repose into a front, fully pulled-out position, in which the front edge of the pull-out rail 38, or the forwardmost yarn spool 13, is disposed in an area above the front edge of the front needle bed $14_v$. Any arbitrary intermediate pull-out position can be adjusted and held, because the groove-like element 43 is supported via the cord elements 48 on the surface 18 of the spool table 12; this means that the two parallel cord elements 48 on each pull-out rail 38 not only provide the sliding connection between this rail 38 and the surface 18 of the spool table, but also function as a brake, so that not only the rear position of repose but any arbitrary intermediate position can be held.

Figure 3:
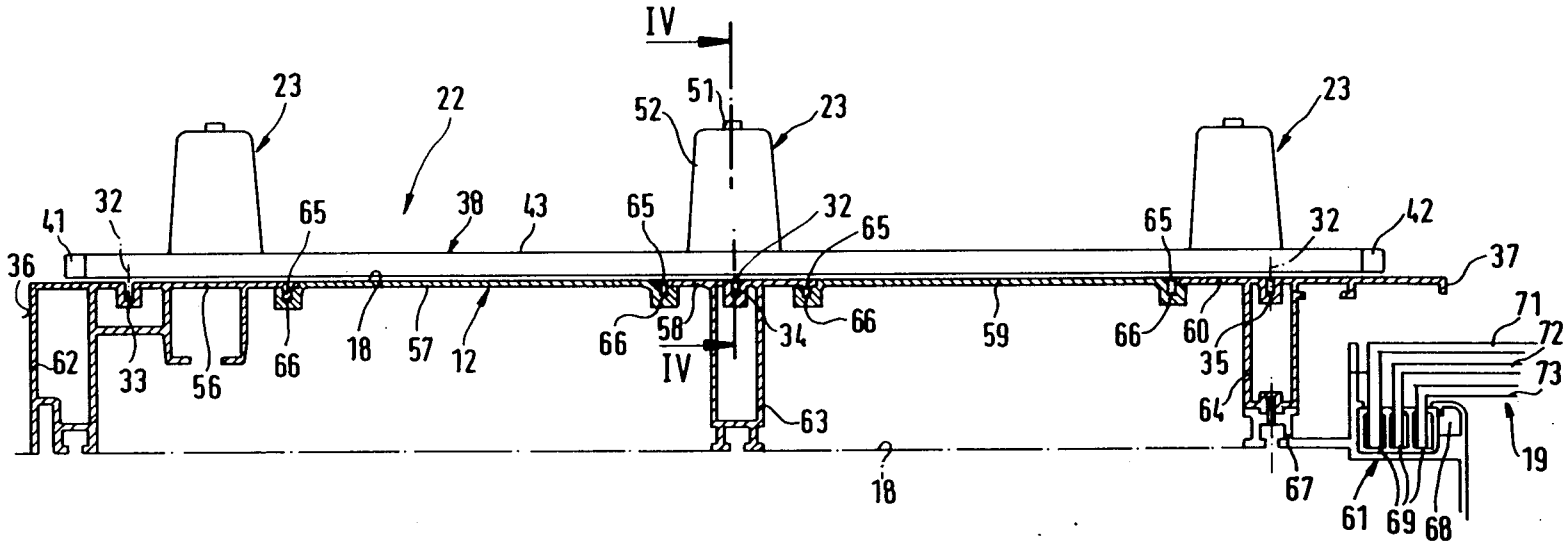
FIG. 3 is a section taken along the line III—III of FIG. 2 with the yarn spool holders mounted in place, and on a larger scale.
Figure 4:
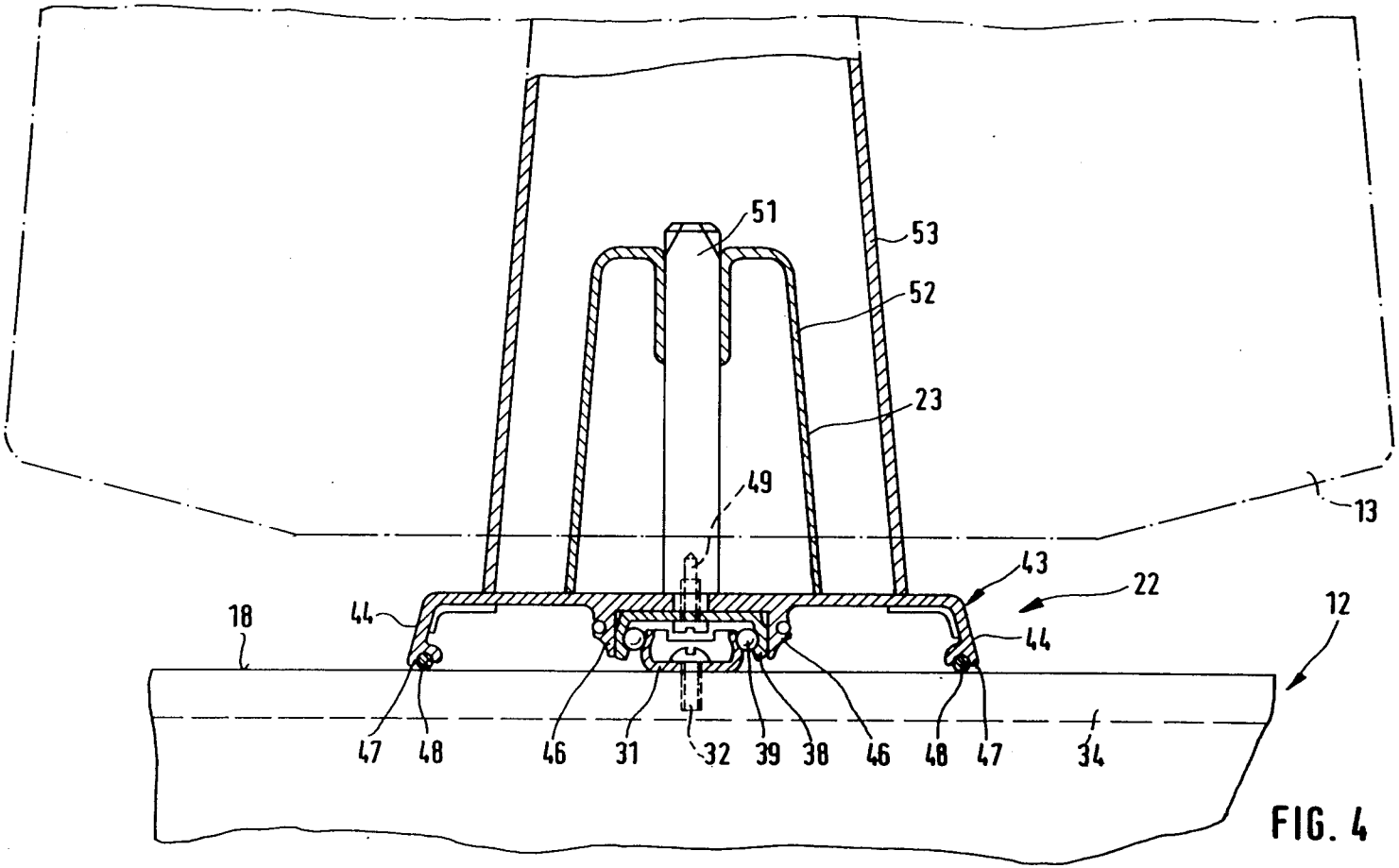
FIG. 4, also on a larger scale, is a section taken along the line IV—IV of FIG. 3.

According to FIG. 3, the spool table 12 is composed of a plurality of elongated extruded profile elements 56–61 made of aluminum. The outer left-hand profile element 56, the middle profile element 58 and the right-hand profile element 60 are provided with profiled hollow supports 62, 63 and 64, respectively, by way of which the spool table 12 is secured directly or indirectly to the rear machine frame 16. These profile elements 56, 58 and 60 are interconnected by intervening profile elements 57 and 59 such that ledges 65, molded on vertically downward, of one element fit into molded-on grooves 66 of the other elements, such that the surface 18 is flat over its entire area. The securing grooves 33-35 for the pull-out apparatuses 22 are provided in the profile elements 56, 58 and 60, respectively. The outer right profile element 61, located below the profile element 60, has a foot 67 on one side, disposed between the hollow support 64 of the profile element 60 and where the rear machine frame 16 is supported, and a holder 68 on the other, in which the protective cover 19 fits or is received. The protective cover 19, as shown in FIG. 3, comprises a plurality of pairs, preferably three in number, of hoods 71–73, which are arranged to be displaceable in different planes; the bent ends of the hoods engage the holder 68 or individual holder tracks 69, in which they are on the one hand supported and on the other hand slidably retained.

Although the pull-out apparatus 22 is shown here as having a set of three yarn spool holders, it will be appreciated that each set may also comprise fewer than or more than three yarn spool holders; also, the yarn spool holders may also be disposed next to one another or offset behind one another on the pull-out apparatus. The arrangement of the yarn spool holders 23 on a pull-out apparatus 22, and the arrangement of the pull-out apparatuses 22 relative to one another, are determined by the maximum diameter of the yarn spools 13 that are to be mounted thereon, and by the attainable accessibility of the yarn spools of the back rows without hindrance from the yarn spools of the front row or rows.

What is claimed is:

1. A flat-bed knitting machine, comprising:

a needle bed apparatus;

a carriage apparatus;

a spool table disposed in the rear area of the machine above the needle bed apparatus and the carriage apparatus;

at least one pull-out apparatus mounted to the spool table, each pull-out apparatus including a guide rail, a pull-out rail movable relative to the guide rail and at least one yarn spool holder mounted to the pull-out rail; and a yarn supply device for each yarn spool holder.

2. The flat-bed knitting machine as defined in claim 1, wherein the spool table is stationary and each guide rail is secured on the stationary spool table.

3. The flat-bed knitting machine as defined in claim 2, wherein the spool table includes a plurality of parallel and longitudinally extending grooves within which the guide rails are secured, said guide rails extending at an angle to said grooves.

4. The flat-bed knitting machine as defined in claim 1, wherein each pull-out rail is extendable to beyond the area of the front of the needle bed apparatus.

5. The flat-bed knitting machine as defined in claim 1, wherein the guide rails extend, at an acute angle to the transverse direction of the spool table, and wherein a plurality of yarn spool holders are provided on each pull-out rail forming a set one after the other.

6. The flat-bed knitting machine as defined in claim 1, wherein each guide rail extends from the back edge to the front edge of the spool table.

7. The flat-bed knitting machine as defined in claim 1, wherein each pull-out apparatus further includes an elongated element covering at least a part of the length of the pull-out rail, said elongated element having a groove-like profile with downwardly projecting side walls supported on the surface of the spool table.

8. The flat-bed knitting machine as defined in claim 7, wherein the elongated element extends over the entire length of the pull-out rail and holds the yarn spool holders.

9. The flat-bed knitting machine as defined in claim 8, wherein the side walls are provided on their free edges with a cord element.

10. The flat-bed knitting machine as defined in claim 9, wherein the cord element is plastic.

11. The flat-bed knitting machine as defined in claim 9, wherein the cord element is rubber.

12. The flat-bed knitting machine as defined in claim 1, wherein each pull-out apparatus further includes a brake element.

13. The flat-bed knitting machine as defined in claim 1, where each pull-out rail is provided on its front end with a cap which covers at least part of the guide rail.

14. The flat-bed knitting machine as defined in claim 1, wherein each pull-out apparatus comprises a rocker-type pull-out apparatus.

15. The flat-bed knitting machine as defined in claim 1, wherein the spool table comprises a plurality of interconnected extruded aluminum profile elements provided with a flat surface and with a plurality of parallel and longitudinally extending grooves within the guide rails are secured.

16. The flat-bed knitting machine as defined in claim 15, further comprising:

a protective cover for the needle bed apparatus and the carriage apparatus, and wherein one of said profile elements includes at least one guide holder for the protective cover.

* * * * *